United States Patent [19]

Brown

[11] 4,114,802

[45] Sep. 19, 1978

[54] CENTRIFUGAL APPARATUS WITH BIAXIAL CONNECTOR

[75] Inventor: Richard I. Brown, Northbrook, Ill.

[73] Assignee: Baxter Travenol Laboratories, Inc., Deerfield, Ill.

[21] Appl. No.: 828,476

[22] Filed: Aug. 29, 1977

[51] Int. Cl.[2] ..... B04B 9/00; B04B 5/02

[52] U.S. Cl. ..... 233/26; 233/1 R; 174/86; 339/5 A

[58] Field of Search ..... 233/1 R, 23 R, 24, 25, 233/26, 27; 64/2 R; 74/797; 174/86; 57/60; 339/5 A, 5 R

[56] References Cited

U.S. PATENT DOCUMENTS

| | | | |
|---|---|---|---|
| 3,358,072 | 12/1967 | Wrench | 174/86 |
| 3,986,442 | 10/1976 | Khoja et al. | 74/797 |

OTHER PUBLICATIONS

Science Publication, "New Flow-Through Centrifuge Without Rotating Seals Applied to Plasmapheresis", Yoichiro Ito et al., vol. 189, No. 4207, Sep. 19, 1975, pp. 999, 1000.

*Primary Examiner*—George H. Krizmanich
*Attorney, Agent, or Firm*—Henry W. Collins; Paul C. Flattery; George H. Gerstman

[57] ABSTRACT

Centrifugal processing apparatus in which a processing chamber is rotatably mounted with respect to a stationary base. An umbilical cable segment is fixed at one end substantially along the axis of the processsing chamber at one side thereof, with the other end of the cable segment being attached substantially on the axis in rotationally locked engagement to the processing chamber. In order to minimize stress on the cable segment during rotation thereof, the cable segment is fastened to a connection member which rotates about the axis of the processing chamber and also about another axis which is angled with respect to the processing chamber axis. The other axis has an orientation within the limits of survival of the cable segment during the twisting of the cable segment about its own axis.

11 Claims, 4 Drawing Figures

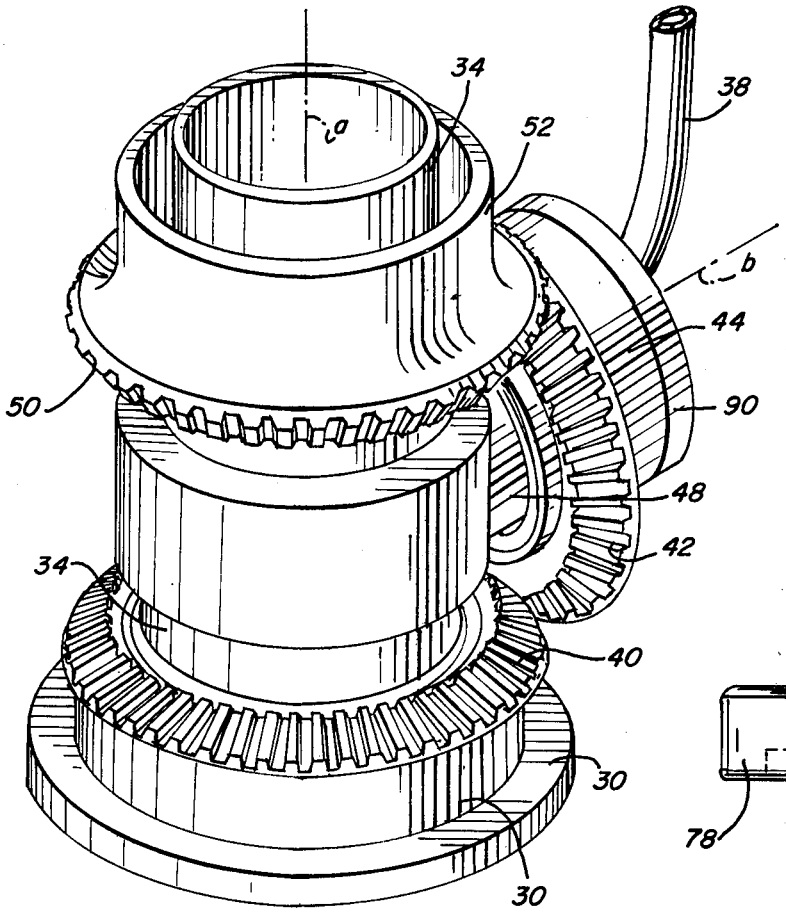
FIG. 2
FIG. 3
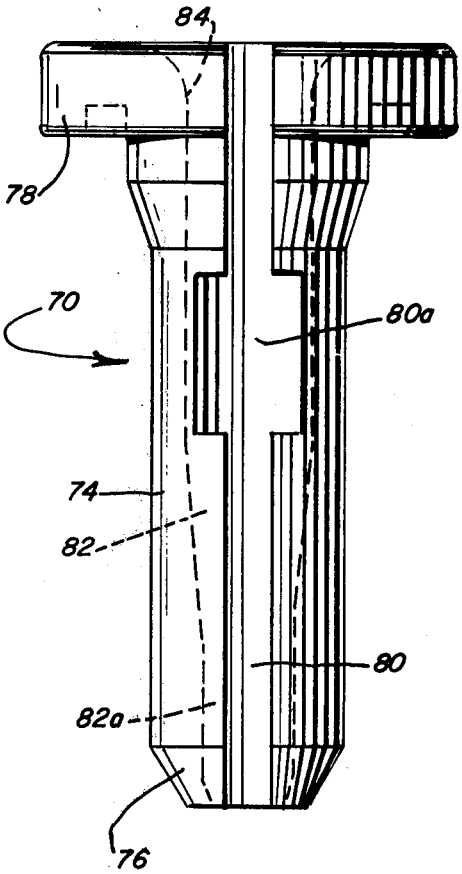
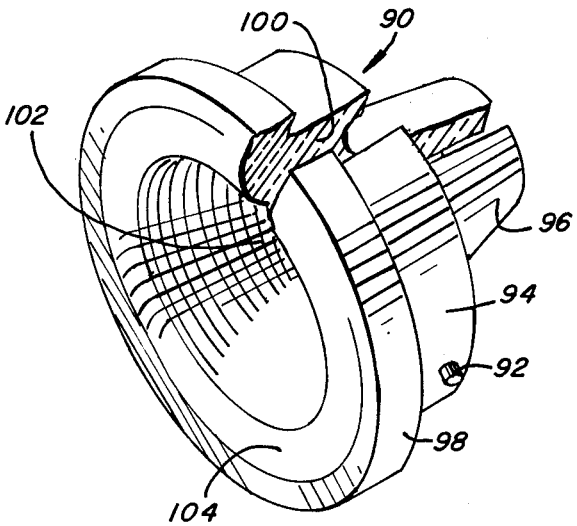
FIG. 4

CENTRIFUGAL APPARATUS WITH BIAXIAL CONNECTOR

BACKGROUND OF THE INVENTION

The present invention concerns centrifugal processing apparatus, and more particularly, apparatus employing umbilical tubing which is rotated with respect to a stationary base.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining red blood cell component in a liquid medium, such as glycerol. Prior to use, the glycerolized red blood cells are thawed and pumped into the centrifugating wash chamber of a centrigual liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red blood cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principles of operation described in Dale A. Adams U.S. Pat. No. 3,586,413. The apparatus of the Adams patent establishes fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

While the Adams patent broadly suggests driving the rotating support to allow the tube to provide the necessary torque for driving the rotating platform, such a tube drive is difficult to achieve because of torsional stresses that are experienced by the umbilical tube and because of the frictional contact of the tube, during rotation thereof, with the machine.

It is, therefore, an object of the present invention to provide centrifugal processing apparatus in which rubbing contact of the umbilical tube with the apparatus is alleviated or obviated, thus reducing or eliminating tubing wear.

Another object of the present invention is to provide centrifugal processing apparatus in which the tubing is connected so as to reduce the torsional stresses in the tubing.

Another object of the present invention is to provide centrifugal processing apparatus in which relatively high speeds may be achieved with the torsional stresses in the tubing being no greater than the torsional stresses in tubing of prior art centrifugal processing apparatus at lower speeds.

A further object of the present invention is to provide centrifugal processing apparatus in which a greater load can be rotated with the same or less torsional stresses than are present in prior art systems having smaller loads.

A still further object of the present invention is to provide centrifugal processing apparatus which allows the use of a broader range of tubing materials in a tube-drive system, by alleviating or obviating rubbing contact of the tubing with the apparatus.

Another object of the present invention is to provide a centrifugal processing apparatus which is constructed to reduce the amount of heat that is normally generated in prior art centrifugal processing apparatus.

A further object of the present invention is to provide a centrifugal processing apparatus which is simplified in construction and is efficient to manufacture.

Other objects and advantages of the present invention will become apparent as the description proceeds.

BRIEF DESCRIPTION OF THE INVENTION

In accordance with the present invention, centrifugal processing apparatus is provided in which a processing chamber is rotatably mounted with respect to a stationary base for rotation about a predetermined axis. An umbilical cable segment is provided for establishing communication with the processing chamber. One end of the cable segment is fixed with respect to the base substantially along the axis at one side of the processing chamber. The other end of the cable segment is attached substantially on the axis in rotationally locked engagement to the processing chamber.

A connection member is provided for minimizing stress, and the cable segment is fastened to the connection member. Means are provided for rotating the connection member about the predetermined axis and for rotating the connection member about another axis which is angled with respect to the predetermined axis.

In the illustrative embodiment, the other axis is the same axis as if the cable were free $\pm$ 0.5 radian. The connector is attached to rotate about the other axis at the same speed as the cable rotation about its own axis.

In the illustrative embodiment, the rotating means comprises a first fixed hollow beveled gear, a second hollow beveled gear disposed at an angle with respect to the first beveled gear and a third hollow beveled gear coaxial with the first beveled gear. The first, second and third beveled gears are intermeshed to form a drive for the processing chamber and the cable segment, with the processing chamber rotating about the predetermined axis at twice the speed of rotation of the cable segment rotation about the predetermined axis.

A more detailed explanation of the invention is provided in the following description and claims, and is illustrated in the accompaning drawings.

BRIEF DESCRIPTION OF THE DRAWINGS

FIG. 2 is a perspective view of a portion of the centrifugal processing apparatus of FIG. 1;

FIG. 3 is a front view of a two ω anchor used in connection with the centrifugal processing apparatus of FIG. 1; and FIG. 4 is an isometric view of a one ω connector used in connection with the centrifugal processing apparatus of FIG. 1.

DETAILED DESCRIPTION OF THE ILLUSTRATIVE EMBODIMENT

Figure 1:
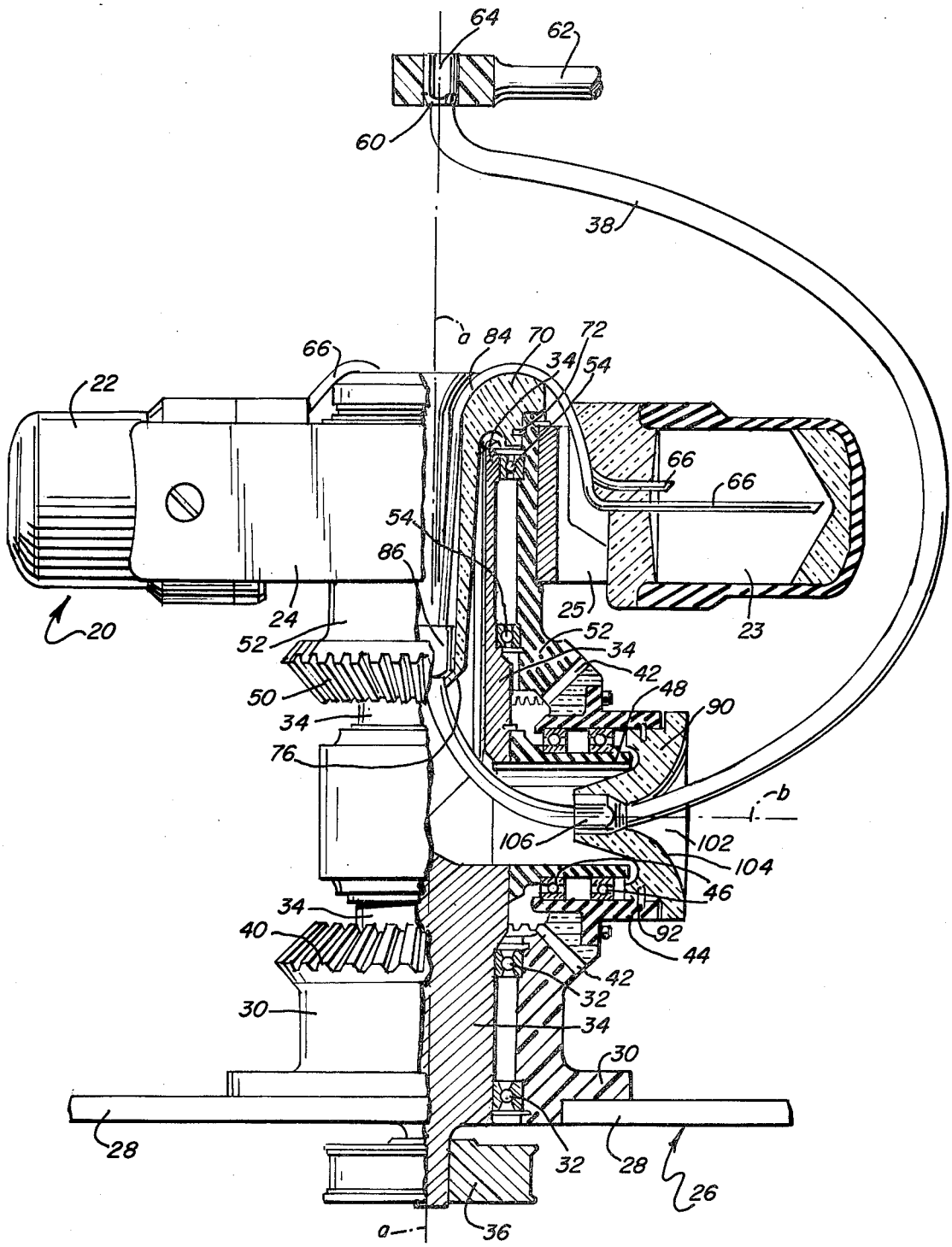
FIG. 1 is an elevational view, with portions cut away and shown partly in cross-section, of centrifugal processing apparatus constructed in accordance with the principles of the present invention.

Referring to FIG. 1, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitably insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 20. Processing chamber 20 includes a pair of support cups 22, 23, which are mounted in diametrically opposed positions on cradles 24, 25, respectively. A pin and slot arrangement may be provided to allow easy attachment and removal of the support cups 22, 23.

A stationary base 26 is provided including a fixed mounting plate 28 fastened to lower bearing base 30. Lower bearing base 30 encloses ball bearings 32 which surround a central shaft 34 which is rotatable about axis *a*. Shaft 34 is keyed to a pulley 36 which is driven by a suitable belt drive (not shown) coupled to an electric motor. Pulley 36 and likewise shaft 34 rotates at one ω to cause the resulting rotation of the umbilical cable segment 38 about axis *a* at one ω and also cause the ultimate rotation of processing chamber 20 about axis *a* at two ω, as will be explained in more detail below.

As used herein, the term "one ω" signifies any rotational velocity and is used as a relative term so that the term "two ω" is used to designate an angular velocity twice the angular velocity of one ω.

Lower bearing base 30 which is fixed to mounting plate 28 carries a fixed beveled gear 40, having a 45° angle with respect to axis *a*. Beveled gear 40 intermeshes with beveled driver gear 42 which is connected to a driver gear holder 44. Driver gear holder 44 is coupled through ball bearings 46 to a one ω rotor arm 48. One ω rotor arm 48 is fastened to central shaft 34 to rotate about axis *a* therewith.

A two ω follower beveled gear 50 is carried by a two ω bearing housing 52 and intermeshes with beveled driver gear 42. Beveled gear 50, like beveled gear 40, extends at a 45° angle with respect to axis *a*. Beveled gears 50 and 40 are hollow, identical in size, face each other and are coaxial. Beveled gear 42 is hollow and has an axis *b* perpendicular and intersecting axis *a* and also is identical in size to beveled gears 50 and 40. Two ω bearing housing 52 is coupled to one ω central shaft 34 by means of bearings 54. Two ω bearing housing 52 is rotatable about axis *a* and is keyed to the processing chamber 20 by means of a direct connection to cradles 24, 25. As a result of the connections herein, one ω rotation of central shaft 30 will result in two ω rotation of bearing housing 52 and connected processing chamber 20.

Fluid communication with the cups 22 and 23, which rotate as part of the processing chamber 20, and with the non-rotating portions of the centrifugal processing system, is provided by means of umbilical cable or tubing 38. Cable 38 defines separate passageways or conduits therein and although illustrated as circular in cross-sectional configuration, could be polygonal in cross-sectional configuration if desired.

Cable 38 is suspended from a point 60 above and axially aligned with processing chamber 20 by means of a stationary fixed torque arm 62. Torque arm 62 is fastened to mounting plate 28. A collar 64, fastened to cable 38, is fixed to torque arm 62.

In a preferred form, cable 38 defines four openings (not shown). Four tubes 66 are connected by bonding adjacent the ends of cable 38, with tubes 66 extending to the interior of cups 22, 23.

While one end of cable 38 is connected to fixed point 60, the other end of cable 38 is attached on axis *a* in rotationally locked engagement to processing chamber 20. To this end, a two ω anchor 70 is fastened to two ω bearing housing 52 by means of a locking pin 72. Locking pin 72 may extend through a slot defined by two ω bearing housing 52 to form a bayonet type mount for anchor 70.

Anchor 70 comprises an elongated main body portion 74, an inwardly tapered end portion 76, an outwardly extending top portion 78, with a slot 80 defined by one side thereof. With the exception of slot 80, anchor 70 is generally symmetrical about its longitudinal axis and defines a central bore 82 through which cable segment 38 and its lead 66 extend. The walls 84 defining central bore 82 are rounded at top portion 78 in order to provide a smooth support surface for tubes 66, as shown most clearly in FIG. 1.

In order to lock cable 38 within anchor 70, a collar 86, surrounding cable 38 and affixed thereto, is provided. The cable is fastened to anchor 70 by sliding cable 38 and collar 86 through slot 80, with the collar falling through enlarged slot portion 80*a*, and then pulling the cable downwardly to lock collar 86 within a reduced portion 82*a* of bore 82.

In order to reduce stress on cable 38, a connector 90 is fastened to driver gear holder 44 by means of a locking pin 92 or by other suitable fastening means. Locking pin 92 may be inserted within a slot defined by driver gear holder 44 to form a bayonet type mount, if desired.

Connector 90 comprises a main body portion 92, an inwardly tapered inner portion 96 and an outwardly extending end portion 98. Portions 94, 96 and 98 may be formed as one integral unit defining a side slot 100 which communicates with a central bore 102. The walls 104 defining central bore 102 are curved, as most clearly shown in FIG. 1, to provide a comfortable support for cable 38. A collar 106 surrounds and is fastened to cable 36 to affix cable 36 to connector 90. To this end, when collar 106 has been placed about cable 38 in fixed engagement therewith, the collar 106 and associated cable 38 are inserted into the connector 90 via slot 100 and are then locked in place within connector 90. In this manner, connector 90 acts as an active support for cable 38 to minimize the stress during turning of cable 38 about its own axis.

In the operation of the system, when pulley 36 is rotated about axis *a* at one $\omega$, connected shaft 30 will also rotate about axis *a* at one $\omega$. Since one $\omega$ rotor arm 48 is fastened to shaft 34, rotor 48 will also rotate about axis *a* at one $\omega$, carrying connector 90 and drivier gear housing 44 therewith about axis *a*. Rotation of connector 90 and attached driver gear holder 44 about axis *a* will cause driver beveled gear 42 to rotate about axis *b* as a result of its engagement with fixed beveled gear 40. In this manner, conductor 90 will rotate about axis *a* and about an axis *b*, simultaneously. Both rotations will occur at one $\omega$ thereby causing beveled gear 50 to rotate at two $\omega$ as a result of the engagement of beveled gear 50 with driver beveled gear 42. In this manner, anchor 70, which is connected to bearing housing 52 carrying beveled gear 50, will rotate about axis *a* at two $\omega$, thereby carrying with it connected processing chamber 20 for rotation about axis *a* at two $\omega$ also.

It can thus be seen that cable 38 will rotate about axis *a* at one $\omega$ with processing chamber 20 rotating about axis *a* at two $\omega$. The rotation of connector 90 about axis *b* will be synchronized with the rotation of tubing 38 about its own axis, thereby minimizing stress on the cable segment 38.

In the illustrative embodiment, axis *b* is perpendicular with and intersecting axis *a*. In order to minimize stress with respect to cable 38, it is preferable that the connection member 90 be rotated about an axis that is substantially the same axis as if the cable were free $\pm$ 0.5 radian. Although a fixed mount has been shown in the illustrative embodiment, a self-aligning mount may be used. In this manner, the angle of cable 38 and the connector can vary in accordance with the cable configuration and movement of the cable during rotation thereof.

Thus it is seen that connector 90 rotates about two axes, one of which is the axis of rotation of the processing chamber and the other of which is at an angle with the processing chamber axis. The angle is such that the other axis is substantially ($\pm$ 0.5 radian) the axis of the cable at the point of connection. The other axis should have an orientation within the limits of survival of the cable 38 during its twisting about its own axis.

Although an illustrative embodiment of the invention has been shown and described, it is to be understood that various modifications and substitutions may be made without departing from the novel spirit and scope of the present invention.

What is claimed is:

1. Centrifugal processing apparatus, which comprises:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the processing chamber;

a connection member for supporting the cable segment and for minimizing stress on the cable segment;

means fastening said cable to said connection member; and means for rotating said connection member about said predetermined axis and for rotating said connection member about another axis which is angled with respect to said predetermined axis.

2. Centrifugal processing apparatus as described in claim 1, said other axis being coaxial with said cable at the point of connection.

3. Centrifugal processing apparatus as described in claim 1, said fastening means comprising a self-aligning mount by which the angle of the cable relative to the connector can vary.

4. Centrifugal proceesing apparatus as described in claim 1, said other axis being substantially the same axis as if the cable were free.

5. Centrifugal processing apparatus as described in claim 1, said other axis being the same axis as if the cable were free $\pm$ 0.5 radian.

6. Centrifugal processing apparatus as described in claim 1, said rotating means being operable to rotate said connector about said other axis at the same speed as the cable rotation about its own axis.

7. Centrifugal processing apparatus as described in claim 1, said rotating means including a rotatable support; means attaching said connection member to said rotatable support, said attaching means comprising a bayonet connector.

8. Centrifugal processing apparatus as described in claim 1, said rotating means comprising a first fixed hollow beveled gear, a second hollow beveled gear disposed at an angle with respect to said first beveled gear, a third hollow beveled gear coaxial with said first beveled gear, said first, second and third beveled gears being intermeshed to form a rotational drive for said processing chamber and said cable segment, with said processing chamber rotating about said predetermined axia at twice the speed of rotation of said cable segment about said predetermined axis.

9. Centrifugal processing apparatus as described in claim 8, including means for attaching said connection member to said second beveled gear, said attaching means comprising a bayonet connector.

10. Centrifugal processing apparatus, which comprises:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the processing chamber;

a connection member for supporting the cable segment and for minimizing stress;

means fastening said cable segment to said connection member;

means for rotating said connection member about said predetermined axis and for rotating said connection member about another axis which is angled with respect to said predetermined axis, said other axis being the same axis as if the cable were free ± 0.5 radian;

said rotating means being operable to rotate said connector about said other axis at the same speed as the cable rotation about its own axis; and said rotating means comprising a first fixed beveled gear, a second beveled gear disposed at an angle with respect to said first beveled gear, a third beveled gear coaxial with said first beveled gear, said first, second and third beveled gears being intermeshed to form a drive for said processing chamber and said cable segment, with said processing chamber rotating about said predetermined axis at twice the speed of rotation of said cable segment about said predetermined axis.

11. Centrifugal processing apparatus as described in claim 10, including means for attaching said connection member to said second beveled gear, said attaching means comprising a bayonet connector.

* * * * *